US008905085B2

(12) United States Patent
Donohue

(10) Patent No.: US 8,905,085 B2
(45) Date of Patent: Dec. 9, 2014

(54) APPARATUS FOR EDGE SEALING AND SIMULTANEOUS GAS FILLING OF INSULATED GLASS UNITS

(75) Inventor: Morgan Donohue, North Oaks, MN (US)

(73) Assignee: Erdman Automation Corporation, Princeton, MN (US)

( * ) Notice: Subject to any disclaimer, the term of this patent is extended or adjusted under 35 U.S.C. 154(b) by 285 days.

(21) Appl. No.: 13/595,143

(22) Filed: Aug. 27, 2012

(65) Prior Publication Data

US 2013/0061978 A1 Mar. 14, 2013

Related U.S. Application Data

(60) Provisional application No. 61/532,664, filed on Sep. 9, 2011.

(51) Int. Cl.
*E06B 3/677* (2006.01)
*B65B 3/04* (2006.01)

(52) U.S. Cl.
CPC ..... *B65B 3/04* (2013.01); *E06B 3/6775* (2013.01)
USPC ..... 141/8; 141/48; 141/59; 141/66; 141/98; 156/109

(58) Field of Classification Search
CPC ..... E06B 3/677; E06B 3/6775
USPC ..... 141/4, 8, 47–48, 59, 65–66, 98; 156/109
See application file for complete search history.

(56) References Cited

U.S. PATENT DOCUMENTS

| | | | | |
|---|---|---|---|---|
| 3,683,974 | A * | 8/1972 | Stewart et al. | 141/4 |
| 4,369,084 | A | 1/1983 | Lisec | |
| 4,670,954 | A | 6/1987 | Lisec | |
| 4,886,095 | A | 12/1989 | Lisec | |
| 4,909,874 | A | 3/1990 | Rueckheim | |
| 4,921,022 | A | 5/1990 | Lisec | |
| 5,080,146 | A * | 1/1992 | Arasteh | 141/4 |
| 5,110,337 | A * | 5/1992 | Lisec | 141/59 |
| 5,377,473 | A | 1/1995 | Narayan et al. | |
| 5,413,156 | A | 5/1995 | Lisec | |
| 5,439,716 | A | 8/1995 | Larsen | |
| 5,476,124 | A | 12/1995 | Lisec | |
| 5,573,618 | A | 11/1996 | Rueckheim | |

(Continued)

FOREIGN PATENT DOCUMENTS

| | | |
|---|---|---|
| EP | 269194 A1 | 6/1988 |
| EP | 324333 A2 | 7/1989 |

(Continued)

*Primary Examiner* — Nicolas A Arnett
(74) *Attorney, Agent, or Firm* — Patterson Thuente Pedersen, P.A.

(57) ABSTRACT

A device for simultaneously edge sealing and gas filling an insulated glass unit, the insulated glass unit including a supporting structure that supports the insulated glass unit in a working position and a gas filling module including a gas fill injection structure and a displaced air extraction structure and a gas metering unit. The device also includes an edge sealing module having a sealant metering device, an edge sealing dispensing head, and an edge sealing dispensing nozzle. The device also includes a control device programmed with an algorithm to initiate gas filling substantially simultaneously with initiating edge sealing of the insulated glass unit and to complete the gas filling of the insulated glass unit prior to completion of the edge sealing.

19 Claims, 11 Drawing Sheets

(56) References Cited

U.S. PATENT DOCUMENTS

| | | | | |
|---|---|---|---|---|
| 5,626,712 | A | 5/1997 | Lisec | |
| 5,645,678 | A | 7/1997 | Lisec | |
| 5,676,782 | A | 10/1997 | Lisec | |
| 5,679,419 | A | 10/1997 | Larsen | |
| 5,714,214 | A | 2/1998 | Larsen | |
| 5,735,318 | A * | 4/1998 | Vianello | 141/67 |
| 5,753,069 | A | 5/1998 | Rueckheim | |
| 5,957,169 | A | 9/1999 | Trpkovski | |
| 6,068,720 | A * | 5/2000 | McHugh | 141/66 |
| 6,158,483 | A | 12/2000 | Trpkovski | |
| 6,216,751 | B1 | 4/2001 | Trpkovski | |
| 6,553,728 | B1 | 4/2003 | Zurn | |
| 6,804,924 | B2 | 10/2004 | Zurn et al. | |
| 6,896,440 | B2 | 5/2005 | Trpkovski et al. | |
| 6,916,392 | B2 | 7/2005 | Trpkovski | |
| 7,184,146 | B2 | 2/2007 | Trpkovski | |
| 7,299,844 | B2 * | 11/2007 | Lisec | 141/66 |
| 8,196,635 | B2 * | 6/2012 | Lenhardt | 156/578 |
| 8,522,831 | B2 * | 9/2013 | Vianello | 141/4 |
| 8,627,856 | B2 * | 1/2014 | McHugh | 141/66 |
| 2004/0211142 | A1 | 10/2004 | Zurn et al. | |
| 2009/0205743 | A1 * | 8/2009 | Vianello | 141/4 |
| 2010/0032103 | A1 * | 2/2010 | Lenhardt | 156/556 |

FOREIGN PATENT DOCUMENTS

| | | | |
|---|---|---|---|
| EP | 389706 | A2 | 10/1990 |
| EP | 403058 | A1 | 12/1990 |
| EP | 324333 | A3 | 3/1991 |
| EP | 269194 | B1 | 1/1992 |
| EP | 324333 | B1 | 5/1992 |
| EP | 403058 | B1 | 7/1995 |
| EP | 389706 | B1 | 8/1996 |
| EP | 603148 | B1 | 12/1996 |
| EP | 799362 | A1 | 10/1997 |
| EP | 674085 | B1 | 5/1998 |
| EP | 674086 | B1 | 5/1998 |
| EP | 674087 | B1 | 5/1998 |
| EP | 1019609 | A1 | 7/2000 |
| EP | 799362 | B1 | 8/2000 |
| EP | 644977 | B1 | 10/2001 |
| EP | 1230463 | A2 | 8/2002 |
| EP | 1063383 | A3 | 9/2002 |
| EP | 674086 | B2 | 8/2004 |
| EP | 1019609 | B1 | 12/2005 |
| WO | WO 9319274 | A1 | 9/1993 |
| WO | WO 9620328 | A1 | 7/1996 |
| WO | WO 9922106 | A1 | 5/1999 |
| WO | WO 0136827 | A2 | 5/2001 |
| WO | WO 0136827 | A3 | 12/2001 |
| WO | WO 0242593 | A1 | 5/2002 |
| WO | WO 03001016 | A2 | 1/2003 |
| WO | WO 2005005968 | A2 | 1/2005 |
| WO | WO 2010077409 | A2 | 7/2010 |
| WO | WO 2010007409 | A3 | 5/2011 |

* cited by examiner

APPARATUS FOR EDGE SEALING AND SIMULTANEOUS GAS FILLING OF INSULATED GLASS UNITS

CLAIM TO PRIORITY

This Application claims the benefit of U.S. Provisional Application No. 61/532,664, filed Sep. 9, 2011, entitled "APPARATUS FOR EDGE SEALING AND SIMULTANEOUS GAS FILLING OF INSULATED GLASS UNITS," which is incorporated by reference herein in its entirety.

FIELD OF THE INVENTION

The invention relates generally to the field of manufacturing insulated glass units. More specifically, the device relates to edge sealing of insulated glass units and gas filling of insulated gas units.

BACKGROUND OF THE INVENTION

Insulated glass is heavily utilized in modern residential and commercial construction. In many areas of the country it is required by building code as an energy conservation measure. A single pane of glass alone has very little insulating value. Multi-pane insulated glass windows have much greater insulating value. Insulated glass units (IGUs) generally include two panes of glass separated by a space. Sealants and adhesives are used to bond the glass panes to a perimeter spacer which separates the two panes of glass. The entire perimeter including the two panes of glass and the spacer are sealed to one another to eliminate movement of ambient air into the space between the two panes of glass. The space is filled with dehydrated air or more commonly another gas such as argon, xenon or krypton. Sulfur hexafluoride is also used for gas filling. The filling of insulated glass units with argon or another gas that is not air has been found to increase the energy efficiency of the insulated glass units markedly. Some insulated glass units includes three panes of glass with two intervening spaces which are similarly filled with argon or another gas other than air and then edge sealed.

Current technology includes a number of techniques for filling insulated glass units with gases other than air. According to some techniques, the insulated glass unit is assembled in a chamber filled with the argon or other gas, trapping the argon between the two panes and within the spacer. In other techniques, the insulated glass unit is preassembled, the argon or other gas is injected while air is removed and then the insulated gas unit is edge sealed.

In any case, the construction of insulated glass units generally involves the use of two separate manufacturing stations, two separate processes and two separate operators to gas fill and edge seal insulated glass units plus time utilized to do the separate operations.

SUMMARY OF THE INVENTION

The present invention solves many of the above-discussed problems. The present invention includes a device and method of manufacturing insulated glass units that includes gas filling of the insulated glass unit simultaneously with edge sealing of the insulated glass unit.

An example embodiment of the invention generally includes an automated edge sealing apparatus along with an automated gas filling apparatus. A method according to an embodiment of the invention, includes beginning the edge sealing process at approximately the same time as beginning the gas filling process wherein the gas filling process is completed prior to completion of the edge sealing of the insulated gas unit.

In one example embodiment, the edge sealing and simultaneous gas filling device includes a fully automated edge sealing device and a gas filling device. The fully automated edge sealing device generally includes a table, a gantry, a traveler, a sealant dispensing head operably coupled to the traveler, a sealant supply and a sealant pump.

The table is configured to support the insulated glass unit being edge sealed and gas filled and generally includes a horizontal surface that may include a conveyor, an air table or a roller support system on which the insulated glass unit may be moved into position for edge sealing and gas filling.

The gantry generally extends over the table and may be supported on two ends thereof on moveable carriers, so that the gantry may travel along the length of the table in an X direction in a controlled fashion. The traveler is supported on the gantry in a moveable fashion so as to be moveable from one end of the gantry to the other in a controlled fashion in the Y direction. movement of the gantry and the traveler are computer controlled The sealant dispensing head is coupled to and supported by the traveler so as to be moveable in the X and Y directions as well as to be rotatable or to support a nozzle that is rotatable to address each side of the insulated glass unit to be edged sealed. The sealant dispensing head includes or is coupled to a metering device that delivers a metered proportional amount of sealant per unit of distance traveled along the edge of the insulated glass unit to accomplish edge sealing and filling the perimeter space with sealant.

The sealant supply includes a vessel containing sealant which can be transported by the sealant pump through conduits to the sealant dispensing head. The sealant supply may include a time setting sealant, a two part sealant or a hot melt sealant.

In other example embodiments the edge sealing device generally includes a hand assist edge sealing device such as that manufactured by Erdman Automation of Princeton, Minn. the assignee of this application or a fixed head edge sealing device such as that disclosed in U.S. published patent application 2012/0118473 the contents of which are incorporated herein by reference. The IGU to be edge sealed and gas filled may also be held in a vertical or nearly vertical position during the edge sealing and gas filling process.

According to an example embodiment of the invention, the gas filling device generally includes a lance structure, a lance support movement structure, a gas supply and gas metering unit. Gases used in gas filling include argon, krypton, xenon and sulfur hexafluoride.

The lance structure is structured in such a way as to pierce the spacer at the perimeter of the insulated glass unit and to engage the perimeter spacer in a generally sealing relationship. In one embodiment, the lance structure may include a single lance design having a pair of coaxial gas channels therein. In this case, one of the coaxial gas channels provides a conduit through which argon or another gas is injected into the insulated glass unit and the other of the coaxial channels provides a passage through which air is extracted from the insulated glass unit.

A dual lance design of the lance structure includes a first lance defining a conduit via which argon or other gas is injected into the interior of the insulated glass unit and a second lance through which displaced air is extracted from the insulated glass unit.

Another embodiment of the invention includes a multiple lance design having more than two lances. In this design, more than one lance is used to inject gas into the insulated glass unit and/or more than one lance is used to withdraw displaced air from the insulated glass unit.

The lance structure is supported by a lance movement and support structure configured to move appropriately to align the lance with the perimeter spacer of the insulated glass unit for insertion and to advance the lance with sufficient force to pierce the perimeter spacer of the insulated glass unit. The lance support movement structure is located generally at the last corner of the insulated glass unit to be edged sealed thereby permitting maximum time for gas insertion and air extraction prior to completion of the edge sealing process.

The gas supply generally includes a pressure vessel containing the gas to be injected into the insulated glass unit.

The gas supply is coupled to the lance structure by a gas metering unit and appropriate gas conduits. The gas metering unit includes a regulator to control gas injection pressure and volume as well as appropriate valves to initiate or stop gas injection as well as a vacuum supply to accomplish air extraction as well as a regulator and valves to control the volume and rate of air extraction relative to the rate of gas injection. The gas metering unit controls gas injection and air extraction appropriately so as to prevent undue stress on the insulated glass unit which might lead to explosion or implosion of the insulated glass unit. Accordingly, the gas injection and displaced air extraction is balanced by the gas metering unit to maintain gas injection and air extraction at approximately equal kilometric rates thereby maintaining the pressure within the IGU at approximately atmospheric pressure.

The invention also includes a method of simultaneously edge sealing and gas filling an insulated glass unit. In one example embodiment, the invention includes placing an insulated glass unit on the table; inserting a lance structure through the perimeter spacer of the insulated glass unit; beginning gas injection and air extraction through conduits of the lance structure; metering the gas injection and air extraction to balance gas injection and air extraction to minimize stress on the insulated glass unit to minimize the risk of explosion or implosion of the insulated glass unit; beginning edge sealing of the insulated glass unit simultaneously with or shortly after beginning gas filling; completing the gas filling prior to completion of the edge sealing of the insulated glass unit; withdrawing the lance structure from the spacer of the insulated glass unit and completing edge sealing of the insulated glass unit.

DETAILED DESCRIPTION

Figure 1:
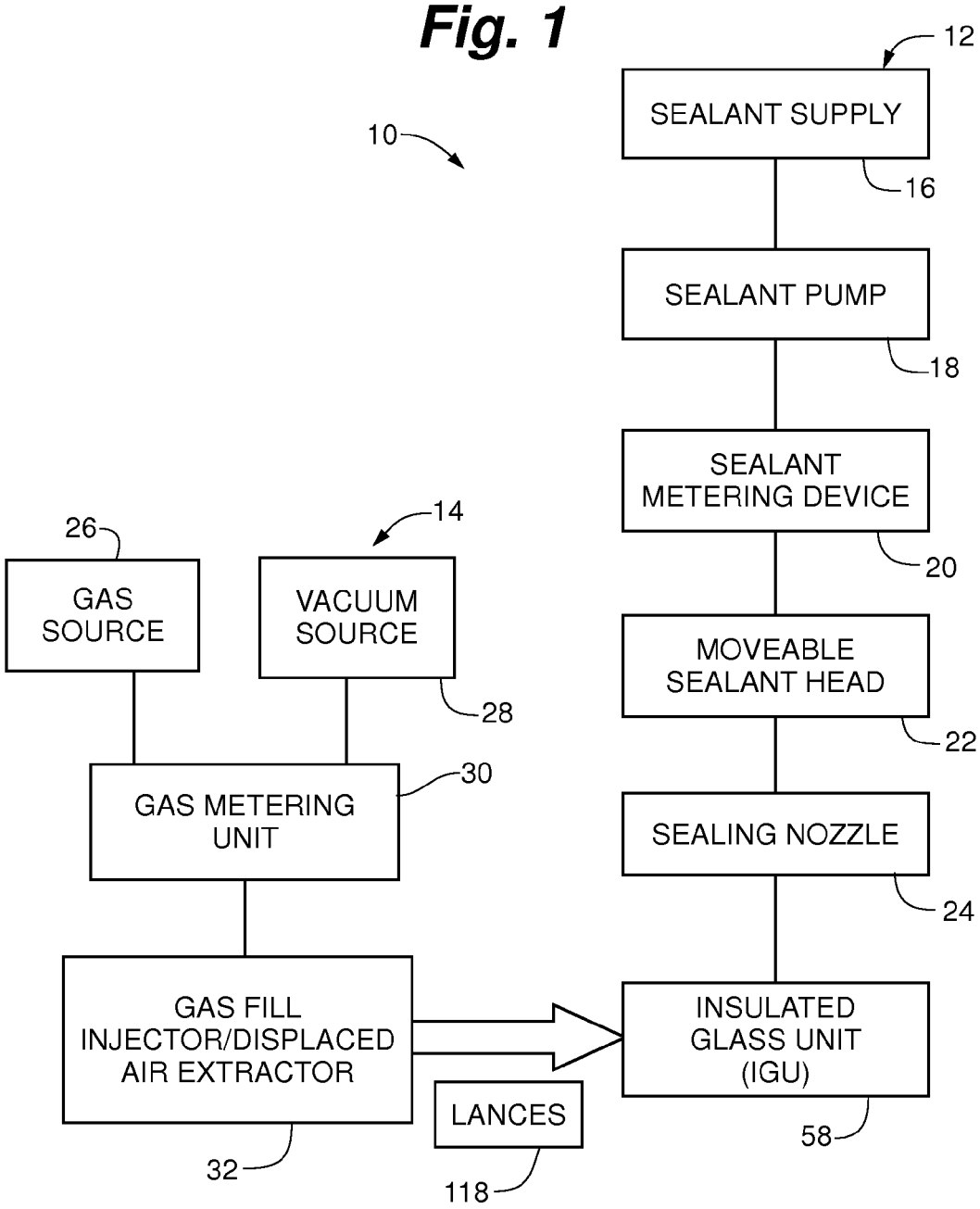
FIG. 1 is a block diagram of an edge sealing and gas filling device according to an example embodiment of the invention.

Referring to FIG. 1, a block diagram according to an embodiment of the invention is depicted. Edge sealing gas filling device 10 generally includes edge sealing module 12 and gas filling module 14.

Edge sealing module 12, according to one example embodiment of the invention, generally includes sealant supply 16, sealant pump 18, sealant metering device 20, moveable sealant applicator head 22 and sealant nozzle 24. Sealant supply 16 generally includes a container filled with a sealant. Sealants may include but are not limited to butyl rubber sealants, silicone sealants, two part epoxy based sealants and most commonly today, hot melt sealants. This list should not be considered to be limiting.

Sealant pump 18 is coupled to sealant supply 16 by appropriate conduits to receive sealant and coupled by further conduits to sealant metering device 20. Sealant metering device 20 measures supplies a measured amount of sealant at a desired rate. Sealant metering device 20 may include a sealant metering device 20 as disclosed for example by U.S. Published application 2006/0011649. Sealant metering device 20 is coupled to moveable sealant applicator head 22 via appropriate flexible conduits. Sealant nozzle 24 is rotatably coupled to moveable sealant applicator head 22 and is configured to direct sealant into the edge space of an insulated glass unit for edge sealing of the insulated glass unit.

Gas filling module 14 generally includes gas source 26 and vacuum source 28 coupled to gas metering unit 30 and gas fill injector/displaced air extractor 32. Gas source 26 generally includes a pressure vessel filled with a desired gas for filling insulated glass units. Generally the gas supplied is argon though other non-air gases may be utilized as well as discussed elsewhere in the this application. Gas source 26 is coupled to gas metering unit 30 by appropriate conduits. Vacuum source 28 may include a vacuum pump or other vacuum source and is coupled to gas metering unit 30 by appropriate conduits. Gas metering unit 30 generally includes appropriate regulators and valves for delivering a measured amount of non-air gas, such as argon, to gas filling injector/displaced air extractor 32 at a known controllable flow rate. Gas metering unit 30 also includes appropriate regulators and valves to provide vacuum to gas filling injector/displaced air extractor 32.

Referring to FIGS. 2A-6, gas fill injector 34 may include gas fill lance 38. Displaced air extractor 36 may include displaced air lance 40. According to one embodiment of the invention, gas fill lance 38 and displace air lance 40 are located side by side and coupled to manifold 42. In an example embodiment, gas fill lance 38 includes shaft 44 and piercer 46. Displace air lance 40 includes shaft 48 and piercer 50. Piercer 46 and piercer 50 are structured appropriately to pierce a spacer of an insulated glass unit without otherwise damaging the insulated glass unit. Piercer 46 and piercer 50 may be formed of metal or another material of sufficient rigidity and hardness to pierce the spacer when a force is applied axially to piercer 46 and piercer 50.

Figure 3:
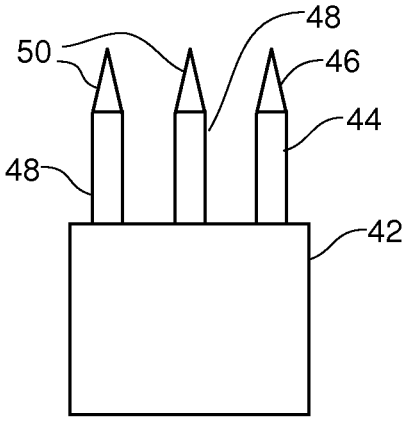
FIG. 3 is a schematic depiction of a multiple lance gas injection-displaced air extraction structure according to example embodiment of the invention.

Referring to FIG. 3, according to another embodiment of the invention, more than one of either or both of gas fill lance 38 and displace air lance 40 may be present coupled in fluid communication with manifold 42.

Figure 4:
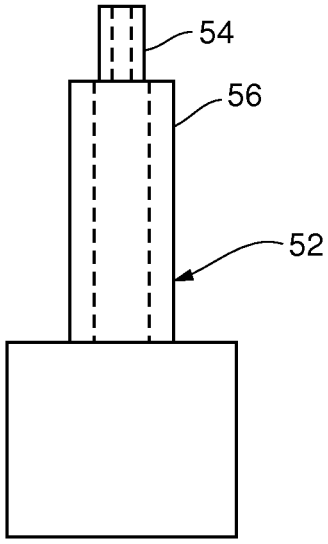
FIG. 4 is schematic plan view of a coaxial lance gas injection-displaced air extraction structure according to example embodiment of the invention.
Figure 5:
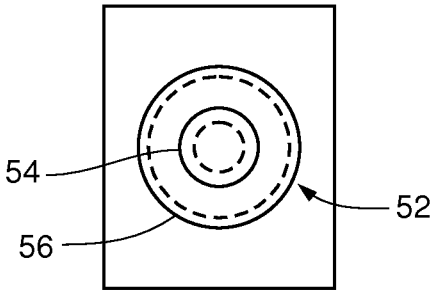
FIG. 5 is a is schematic elevational view of a coaxial lance gas injection-displaced air extraction structure according to example embodiment of the invention.

Referring particularly to FIGS. 4 and 5, gas fill injector/displaced air extractor 32 may include coaxial lance 52. Coaxial lance 52 may include center gas fill conduit 54 and annular extraction conduit 56. The location of gas fill conduit 54 and extraction conduit 56 may also be reversed wherein extraction is accomplished through a center conduit and gas fill accomplished through an annular conduit.

Figure 2A:
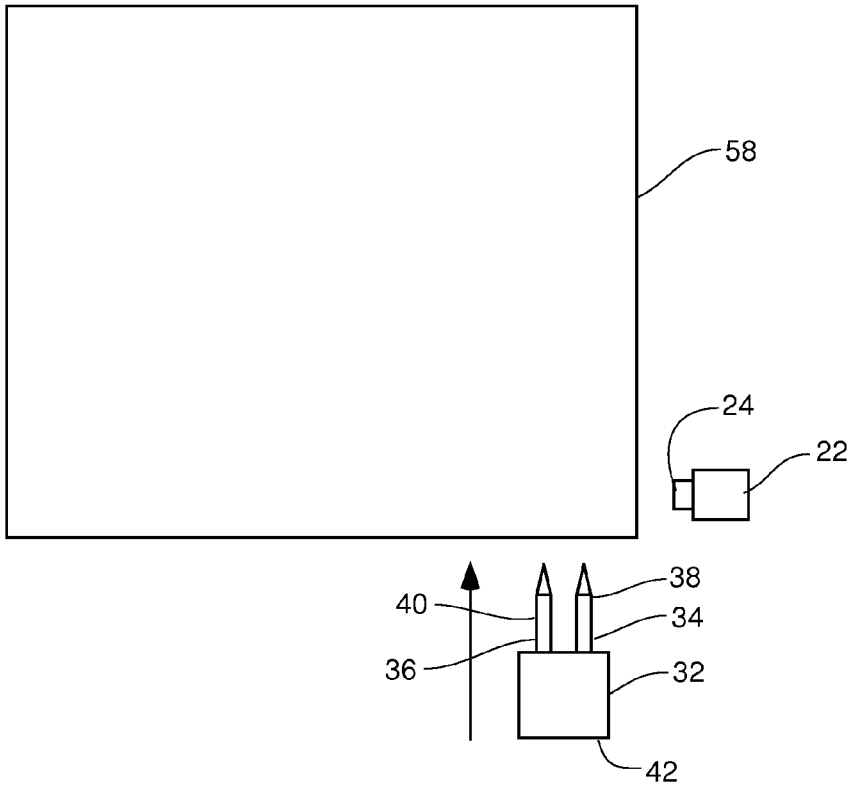
FIGS. 2A-2C depict a schematic sequential representation of an edge sealing and gas filling process according to example embodiment of the invention.
Figure 2B:
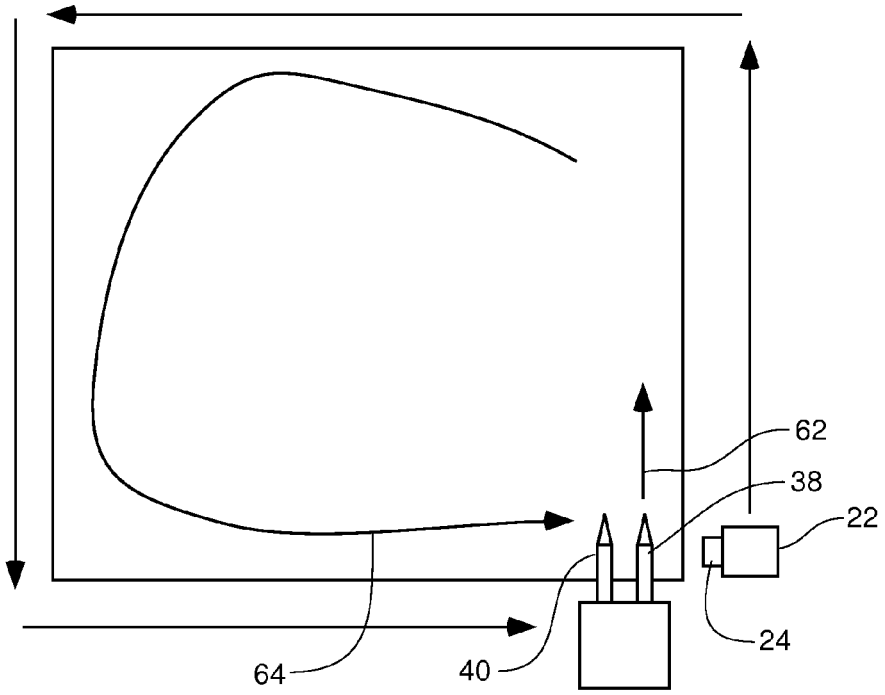
Figure 2C:
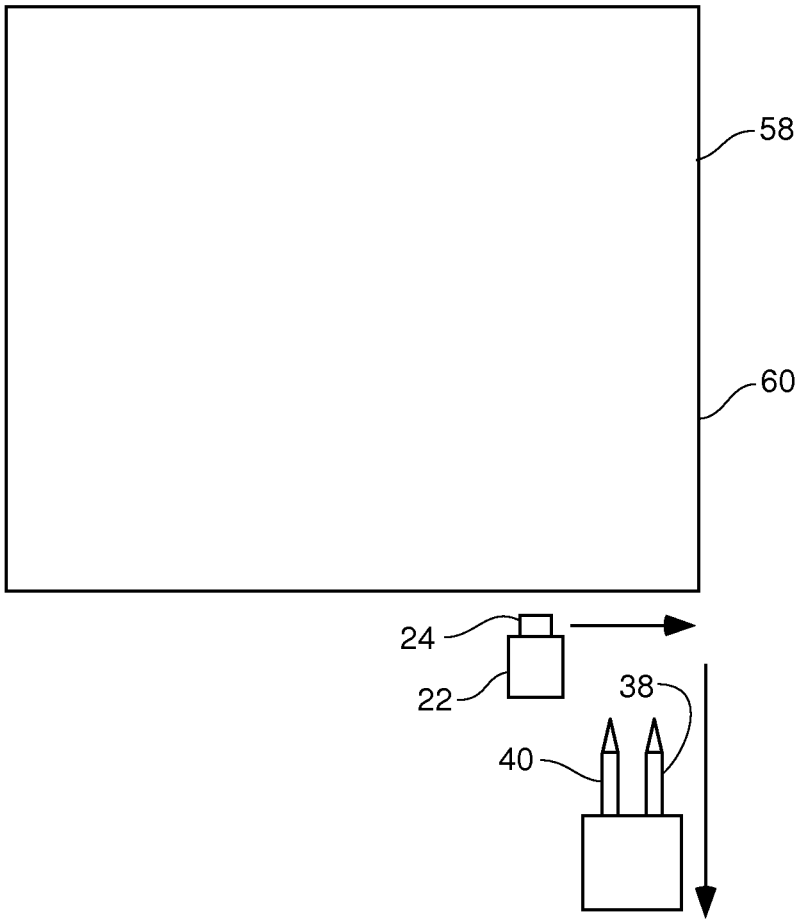

Referring to FIGS. 2A-2C, an insulated glass unit (IGU) 58, gas fill injector/displaced air extractor 32, and moveable sealant applicator head 22 and sealant nozzle 24 are schematically depicted. Referring to FIG. 2A, at the beginning of a combination edge sealing gas filling process, moveable sealant applicator head 22 and sealant nozzle 24 are located at the lower right corner of the right side of IGU 58. Gas fill injector/displaced air extractor 32 is located adjacent the bottom side of IGU 58 near the lower right corner. Gas fill injector/displaced air extractor 32 is advanced toward IGU 58 so that gas fill lance 38 and displaced air lance 40 pierce perimeter spacer 60 of IGU 58. Referring to FIG. 2B, gas fill lance 38 and displaced air lance 40 have been advanced and pierced perimeter spacer 60. Inflow of gas filling 62 is depicted by an arrow while displaced air extraction 64 is depicted by another arrow annotated with these reference numerals. In this example embodiment, edge sealing via sealant nozzle 24 begins at approximately the same time as gas filling 62 and displaced air extraction 64. Sealant nozzle 24 travels around the perimeter of insulated glass unit 58 in a counter clockwise direction supported by moveable sealant applicator head 22.

Referring to FIG. 2C, according to an embodiment of the invention, gas filling 62 and displaced air extraction 64 are completed prior to the arrival of sealant nozzle 24 at the location of gas fill injector/displaced air extractor 32.

As depicted in FIG. 2C, gas fill injector/displaced air extractor 32 is retracted prior to the arrival of sealant nozzle 24 at its location and sealant nozzle 24 completes the trip around the perimeter of insulated glass unit 58 completely edge sealing the unit. As sealant nozzle 24 passes the location at which gas fill injector/displaced air extractor 32 pierced perimeter spacer 60 sealant dispensed by sealant nozzle 24 closes and seals any openings created by the piercing of perimeter spacer 60 resulting in a completed gas filled insulated glass unit 58

Figure 9:
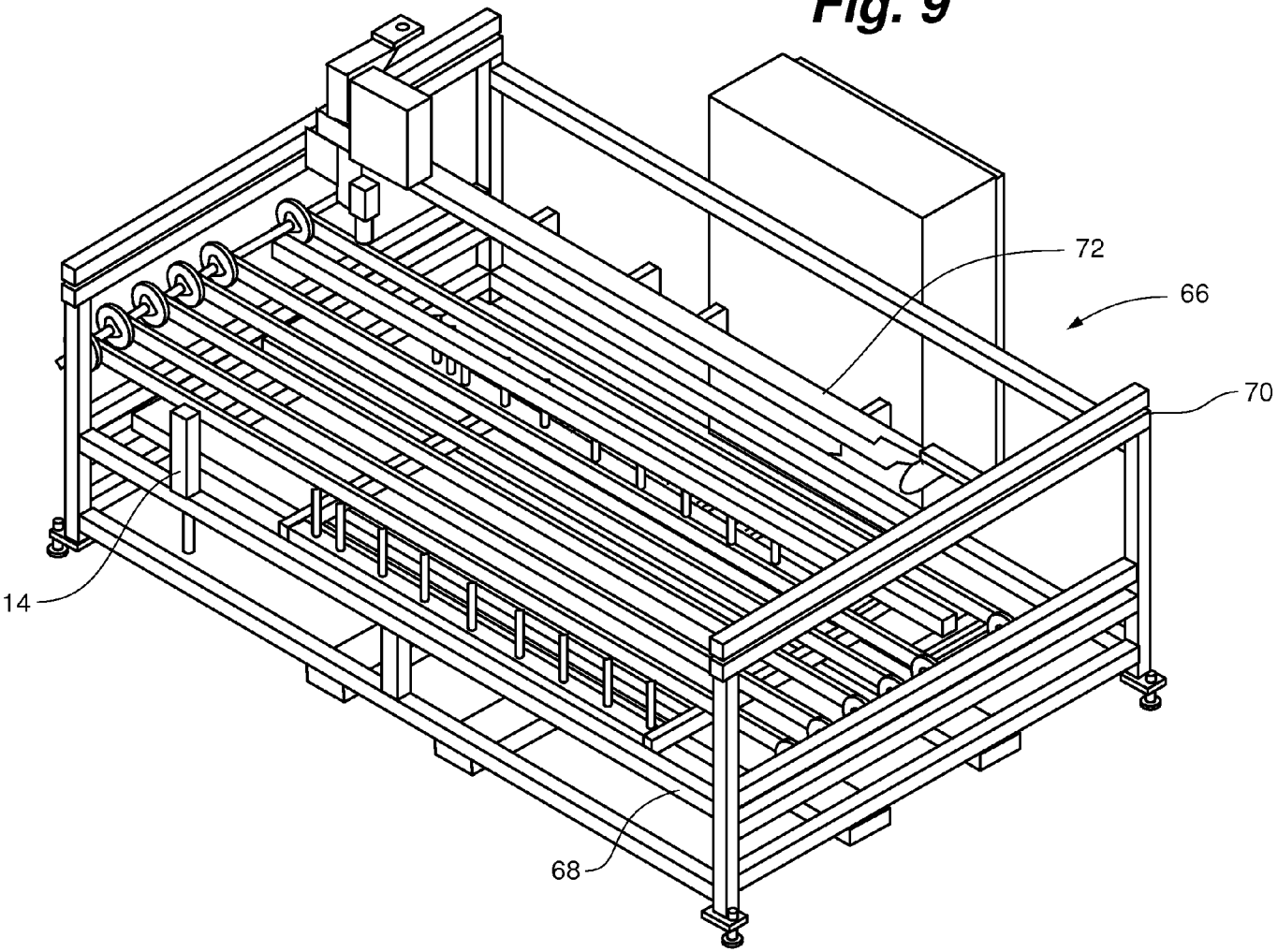
FIG. 9 is a perspective view of an edge sealing and gas filling device according to an example embodiment of the invention.
Figure 10:
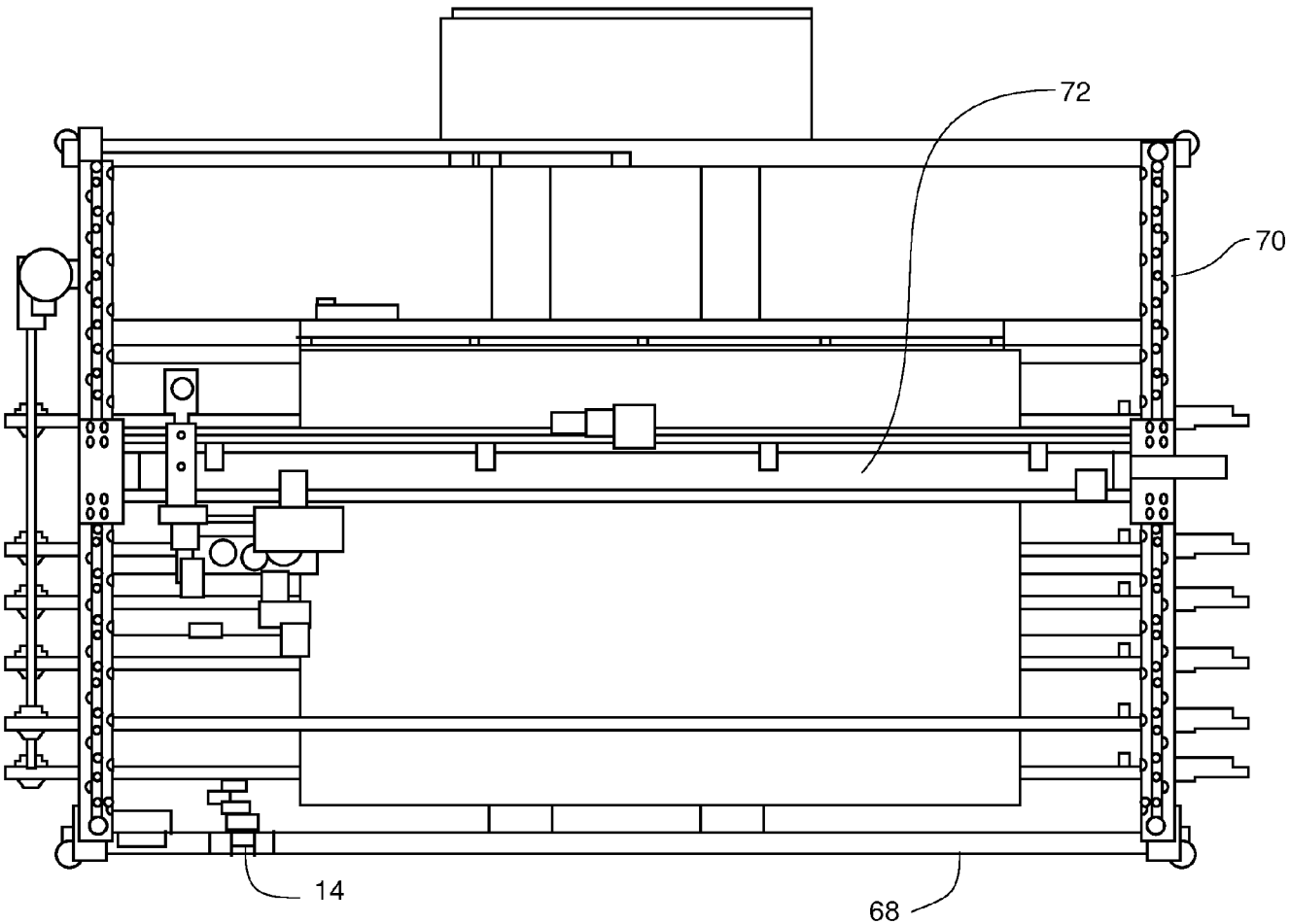
FIG. 10 is a plan view of an edge sealing and gas filling device according to FIG. 9.
Figure 11:
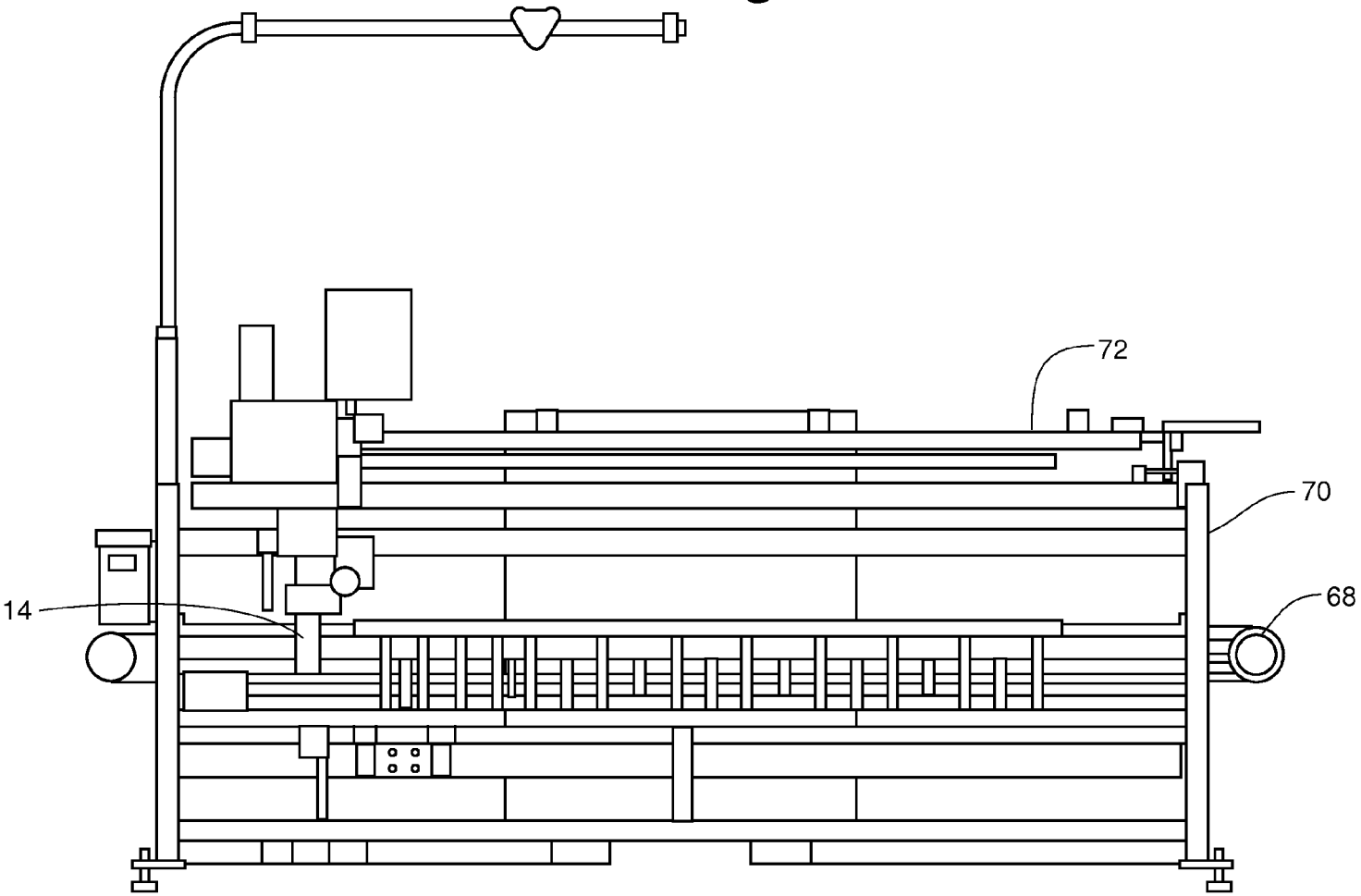
FIG. 11 is an elevational view of an edge sealing and gas filling device according to FIG. 9.

Referring to FIGS. 9-11, edge sealing module 12 may include fully automated edge sealing device 66. In one example embodiment, fully automated edge sealing device 66 includes table 68, gantry 70 and traveler 72. Fully automated edge sealing device 66 also includes sealant supply 16, sealant pump 18, sealant metering device 20, and moveable sealant applicator head 22 coupled to traveler 72. In another embodiment of the invention, edge sealing module 12 may include a fixed head edge sealing device or a manually operated edge sealing device, not depicted.

Figure 6:
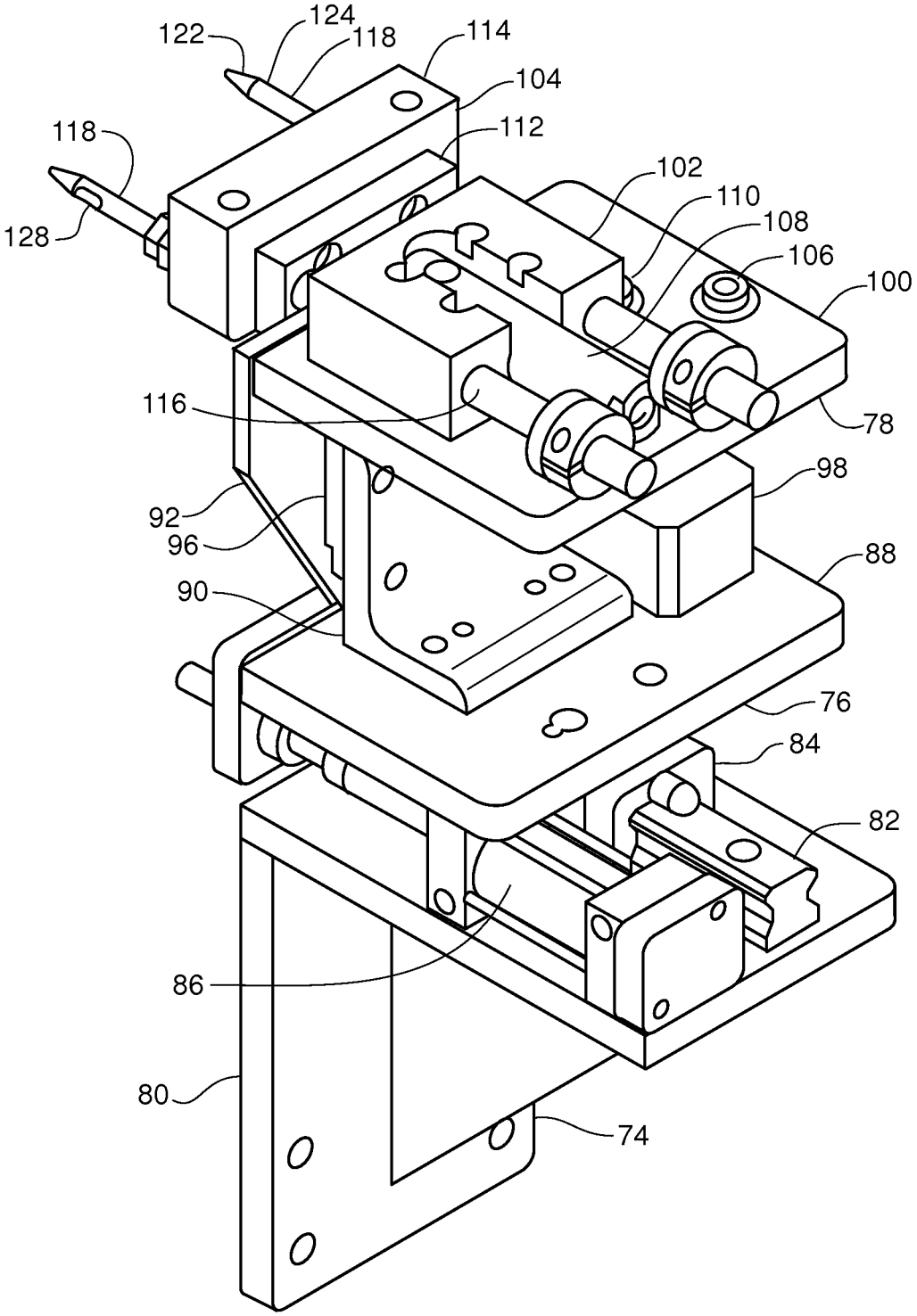
FIG. 6 is a perspective view of a gas injection-displaced air extraction structure according to example embodiment of the invention.
Figure 7:
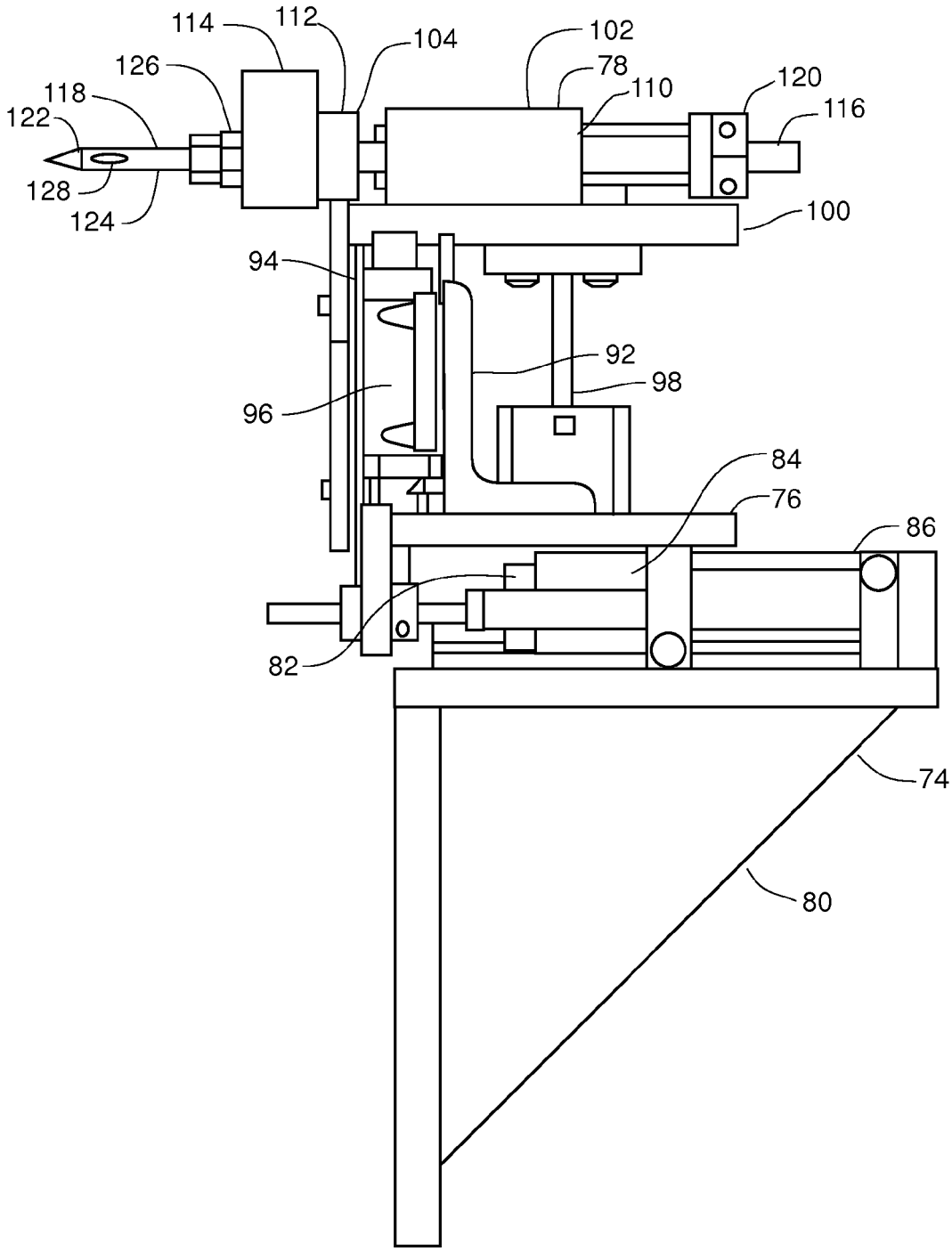
FIG. 7 is a side elevational view of the gas injection-displaced air extraction structure of FIG. 6.
Figure 8:
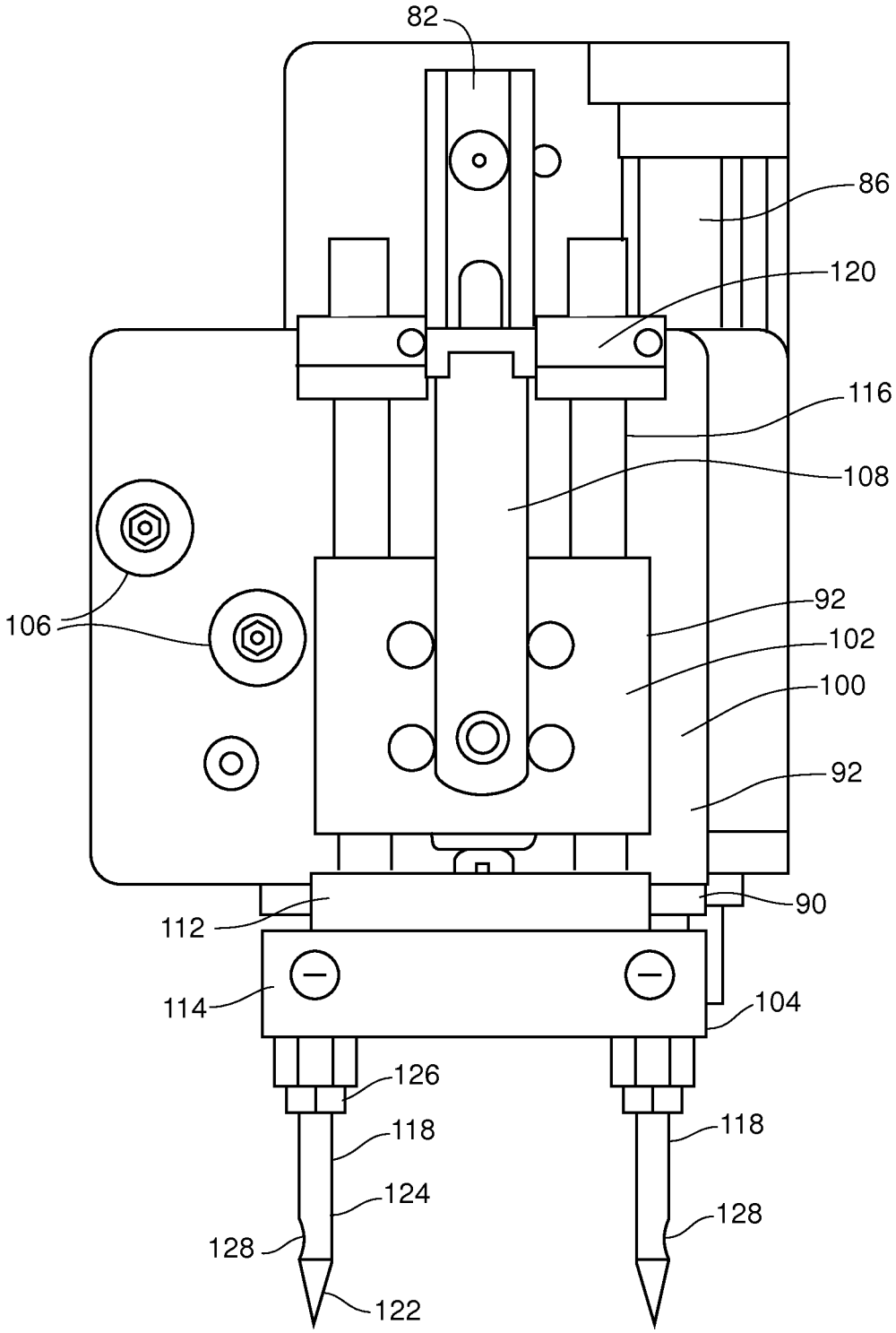
FIG. 8 is plan view of the gas injection-displaced air extraction structure of FIG. 6.

Referring to FIGS. 6-8, example gas fill injector/displaced air extractor 32 generally includes support assembly 74, gas filler assembly 76 and lance block assembly 78.

Support assembly 74 includes support bracket 80, track 82, slider 84 and linear actuator 86. Support bracket 80 is adapted to couple to edge sealing module 12, for example, by fasteners (not shown). Track 82 is coupled to support bracket 80 and engaged to slider 84. Slider 84 is linearly movable on track 82. Slider 84 is coupled to gas filler assembly 76. Linear actuator 86 is coupled to support bracket 80 in a generally parallel orientation to track 82. Linear actuator 86 may include, for example, a pneumatic or hydraulic cylinder or another form of actuator capable of moving in a linear fashion.

Gas filler assembly 76 is coupled to slider 84 and to linear actuator 86. Slider 84 is slidably engaged to track 82. In the depicted embodiment, gas filler assembly 76 generally includes horizontal plate 88, vertical support 90 and lance block support 92. Vertical support 90 is coupled to the lance block support 92 via vertical track 94 and vertical slider 96. Vertical actuator 98 also drivably couples block assembly 78 to lance block support 92. Vertical actuator 98 may include, for example, an electrical, pneumatic or hydraulic vertical actuator.

Lance block assembly 78 generally includes lance support plate 100, lance support block 102 and lance assembly 104. Lance support plate 100 is coupled at generally right angles to vertical track 94 which is operably coupled to vertical slider 96. Vertical actuator fasteners 106 couple lance support plate 100 to vertical actuator 98. Lance support block 102 is coupled to lance support plate 100 by for example, fasteners. Lance assembly 104 is slidably engaged to lance support block 102. Lance support block 102 also includes gas supply/vacuum source coupler 108 and presents slide rod receivers 110.

Lance assembly 104 generally includes small block 112, large block 114, slide rods 116 and lances 118. As depicted, slide rods 116 are slidably engaged to slide rod receivers 110. Slide rods 116 are also coupled to small block 112, which in turn is coupled to large block 114. Large block 114 in turn supports lances 118. Slide rods 116 may further include slide rod stops 120 coupled thereto.

Referring particularly to FIGS. 6 and 8, lances 118 generally include piercing portion 122, tubular portion 124 and mounting portion 126. Tubular portion 124 presents gas aperture 128 in fluid communication with tubular portion 124. Tubular portion 124 is further in fluid communication with gas supply coupler/vacuum source coupler. Gas metering unit 30 is coupled to lances 118 via appropriate conduits for gas supply and vacuum.

Figure 12:
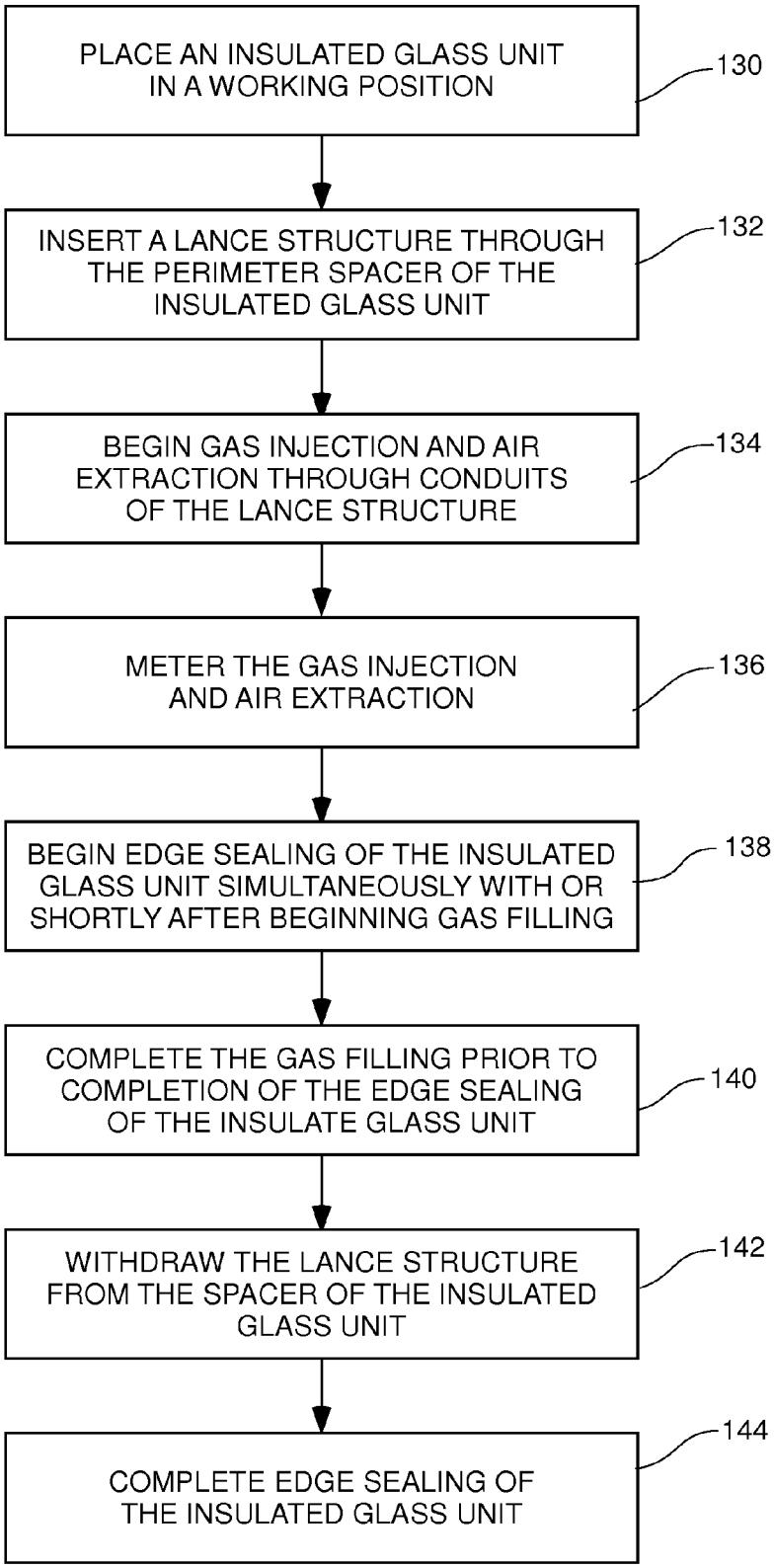
FIG. 12 is a flow chart depicting a method of simultaneously gas filling and edge sealing an insulated glass unit according to an example embodiment of the invention.

Referring to FIG. 12, The invention also includes a method of simultaneously edge sealing and gas filling insulated glass unit 158. In one example embodiment, the invention includes placing insulated glass unit 58 on the table 68 of edge sealing device 66 annotated by reference numeral 130; inserting gas fill lance 38 and displaced air lance 40 through perimeter spacer 60 of insulated glass unit 58 annotated by reference numeral 132; beginning gas filling 62 through gas fill lance 38 and displaced air extraction 64 through displaced air lance 40 annotated by reference numeral 134; metering the gas filling 62 and air extraction 64 to balance gas filling 62 and air extraction 64 annotated by reference numeral 136 to minimize stress on insulated glass unit 58 to minimize the risk of explosion or implosion; beginning edge sealing of the insulated glass unit simultaneously with or shortly before or after beginning gas filling 62 annotated by reference numeral 138; completing gas filling 62 and displaced air extraction 64 prior to completion of edge sealing of insulated glass unit 58 annotated by reference numeral 140; withdrawing lances 118 from perimeter spacer 60 of the insulated glass unit 58 annotated by reference numeral 142 and completing edge sealing of the insulated glass unit 144 including sealing openings in perimeter spacer 60 created by lances 118 annotated by reference numeral 144.

In operation, referring to FIGS. 1 and 2A-2C, an insulated glass unit 58 is placed on table 68 of edge sealing device 66.

Insulated glass unit 58 may be positioned by a conveyor as depicted in FIGS. 9-11, such as by air table or by multidirectional rollers or otherwise. Insulated glass unit 58 is positioned so that, for example, a corner thereof is positioned near lance block assembly 78. Lance assembly 104 is positioned by vertical actuator 98 to be aligned with perimeter spacer 60 so that lances 118 are generally centered on perimeter spacer 60. Linear actuator 86 advances lances 118 while gas filler assembly 76 rides on track 82 and slider 84. Once lances 118 pierce perimeter spacer 60, gas filling metering unit 30 is activated so that gas from gas source 26 is injected into insulated gas unit 58 through gas fill lance 38 and displaced air is withdrawn from within insulated glass unit 58 by vacuum source 28 coupled through displaced air lance 40.

Simultaneous with the gas filling operation, sealant metering device 20 is moved relative to insulated glass unit 58 to follow perimeter spacer 60. Movable sealant applicator head 22 is placed adjacent to insulated glass unit 58 and sealant nozzle 24 is used to direct sealant from sealant supply 16 via sealant pump 18 and sealant metering device 20 to fill the edge of insulated glass unit 58.

For example, movable sealant applicator head 22 can begin secondary edge sealing insulated glass unit 58 at a corner adjacent to the location at which lances 118 are inserted through perimeter spacer 60. According to an embodiment of the invention, gas filling of insulated glass unit 58 is completed prior to edge sealing of insulated glass unit 58. When gas filling is complete, linear actuator 86 is again activated to withdraw lances 118 from perimeter spacer 60. Movable sealant applicator head 22 then completes its circuit around insulated glass unit 58 thus completing the edge sealing of insulated glass unit 58 and sealing off openings made by the passage of lances 118 through perimeter spacer 60.

While this process has been described as involving fully automated edge sealing device 66, edge sealing may also be accomplished simultaneously with gas filling by a hand assist edge sealing device or by a fixed head edge sealing device. In the case of a fixed head edge sealing device, lance assembly 104 is secured to insulated glass unit 58 while insulated glass unit 58 is moved and manipulated past the fixed head edge sealing applicator head.

During the gas filling process gas metering unit 30 controls the flow of gas from gas source 26 and the vacuum from vacuum source 28 to balance gas flow and extraction of displaced air so as not to cause implosion or explosion or excess stress on insulated glass unit 58.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

The invention claimed is:

1. A method of edge sealing and gas filling an insulated glass unit, the insulated glass unit comprising a first pane and a second pane joined by a perimeter spacer and defining a cavity bounded by the first pane, the second pane and the perimeter spacer and also defining an edge space peripheral to the spacer, the method comprising:

placing the insulated glass unit in a working position;

piercing the perimeter spacer with a gas fill injection structure and a displaced air extraction structure at a first location;

gas filling the cavity by injecting a non-air gas through the gas fill injection structure into the cavity and extracting displaced air from the cavity through the displaced air extraction structure;

approximately simultaneously with injecting non-air gas and extracting displaced air, beginning edge sealing of the insulated glass unit by applying a secondary sealant into the edge space;

completing the gas filling of the cavity prior to completing the edge sealing;

withdrawing the gas fill injection structure and the displaced air extraction structure; and completing the edge sealing thereby sealing punctures created by the piercing of the perimeter spacer.

2. The method as claimed in claim 1, further comprising beginning edge sealing at a second location adjacent to the first location.

3. The method as claimed in claim 1, further comprising selecting the non-air gas from a group consisting of argon, xenon, krypton and sulfur hexafluoride.

4. The method as claimed in claim 1, further comprising metering a first flow of the injected non-air gas and a second flow of extracted displaced air to be substantially balanced so as to minimize stress on the insulated glass unit.

5. The method as claimed in claim 1, further comprising selecting the gas fill injection structure and the displaced air extraction structure such that one of the gas fill injection structure and the displaced air extraction structure is annularly surrounding the other of the gas fill injection structure and the displaced air extraction structure.

6. The method as claimed in claim 1, further comprising performing the edge sealing with a fully automated edge sealing device.

7. The method as claimed in claim 1, further comprising performing the edge sealing with a hand assist edge sealing device.

8. The method as claimed in claim 1, further comprising performing the edge sealing with a fixed head edge sealing device.

9. A device for simultaneously edge sealing and gas filling an insulated glass unit, the insulated glass unit comprising a first pane and a second pane joined by a perimeter spacer and defining a cavity bounded by the first pane, the second pane and the perimeter spacer and also defining an edge space peripheral to the spacer, the device comprising:

a supporting structure that supports the insulated glass unit in a working position;

a gas filling module, including a gas fill injection structure and a displaced air extraction structure at a first location supported by an advancing and retracting support structure adjacent the supporting structure;

a gas metering unit operably coupled in fluid communication with the gas fill injection structure and the displaced air extraction structure supplying non-air gas to the gas fill injection structure and vacuum to the displaced air extraction structure;

an edge sealing module including a sealant metering device;

an edge sealing dispensing head in operable fluid communication with the sealant metering device;

an edge sealing dispensing nozzle operably coupled to the edge sealing dispensing head; and a control device operably coupled to the gas filling module and the edge sealing module and programmed with an algorithm that controls the gas filling module to initiate gas filling of the insulated glass unit substantially simultaneously with initiating edge sealing of the insulated glass unit and to complete the gas filling of the insulated glass unit prior to completion of the edge sealing and to complete the edge sealing shortly following retraction of the gas fill injection structure and the displaced air extraction structure from the insulated glass unit.

10. The device as claimed in claim 9, wherein the edge sealing head has a starting position at a second location adjacent to the first location.

11. The device as claimed in claim 9, further comprising a gas supply and a vacuum source in operable fluid communication with the gas metering unit.

12. The device as claimed in claim 9, wherein the gas fill injection structure and the displaced air extraction structure are structured such that one of the gas fill injection structure and the displaced air extraction structure is annularly surrounding the other of the gas fill injection structure and the displaced air extraction structure.

13. The device as claimed in claim 9, wherein the gas fill injection structure and the displaced air extraction structure further comprise a single gas fill lance and multiple displaced air extraction lances.

14. The device as claimed in claim 9, wherein the gas fill injection structure and the displaced air extraction structure further comprise a support assembly, a gas filler assembly and a lance block assembly.

15. The device as claimed in claim 9, wherein the gas fill injection structure and the displaced air extraction structure further comprise a horizontal linear actuator oriented to move the gas fill injection structure and the displaced air extraction structure toward and away from the insulated glass unit and a vertical actuator oriented to move the gas fill injection structure and the displaced air extraction structure substantially perpendicular to a plane of the insulated glass unit.

16. The device as claimed in claim 9, wherein the gas metering unit balances a flow of the non-air gas with a flow extracted displaced air to maintain pressure within the insulated glass unit at approximately atmospheric pressure.

17. The device as claimed in claim 9, wherein the edge sealing module is fully automated.

18. The device as claimed in claim 9, wherein the edge sealing module is hand assisted.

19. The device as claimed in claim 9, wherein the edge sealing module is of fixed head design.

* * * * *